US005636981A

United States Patent [19]

Lilly

[11] Patent Number: 5,636,981

[45] Date of Patent: Jun. 10, 1997

[54] FUEL OIL BURNER

[75] Inventor: Neal T. Lilly, Itasca, Ill.

[73] Assignee: Lilly Engineering Company, Itasca, Ill.

[21] Appl. No.: 246,126

[22] Filed: May 19, 1994

[51] Int. Cl.[6] ..... F23D 14/62

[52] U.S. Cl. ..... 431/354; 431/187; 239/553.5; 239/590.5; 239/427

[58] Field of Search ..... 431/354, 350, 431/326, 344, 346; 239/590, 590.5, 590.3, 553.3, 553.5, 427, 402, 399; 123/590, 593; 48/189.4

[56] References Cited

U.S. PATENT DOCUMENTS

| | | | |
|---|---|---|---|
| 1,038,300 | 9/1912 | Crone | 123/590 X |
| 1,180,478 | 4/1916 | Cook et al. | 123/590 X |
| 1,420,405 | 6/1922 | Beler | 431/346 X |
| 1,593,186 | 7/1926 | McKean et al. | 239/402 |
| 1,874,002 | 8/1932 | Faretz | 48/189.4 X |
| 2,546,515 | 3/1951 | MacBeth | 48/189.4 |
| 3,155,142 | 11/1964 | Stack | 431/346 X |
| 3,287,094 | 11/1966 | Brownell | 431/346 X |
| 3,521,988 | 7/1970 | Flynn | 239/553.5 X |
| 3,785,620 | 1/1974 | Huber | 259/4 |
| 3,867,092 | 2/1975 | Sage et al. | 431/354 |
| 3,871,624 | 3/1975 | Huber et al. | 259/4 |
| 3,918,688 | 11/1975 | Huber et al. | 259/4 |
| 4,022,441 | 5/1977 | Turney . | |
| 4,062,524 | 12/1977 | Brauner et al. | 366/340 |
| 4,220,416 | 9/1980 | Brauner et al. | 366/337 |
| 4,321,905 | 3/1982 | Kurasawa | 123/575 |
| 4,716,737 | 1/1988 | Mandrin | 62/52 |
| 4,758,098 | 7/1988 | Meyer | 366/337 |
| 4,909,730 | 3/1990 | Roussakis et al. | 431/346 |
| 5,255,974 | 10/1993 | Signer | 366/336 |

FOREIGN PATENT DOCUMENTS

| | | | |
|---|---|---|---|
| 475044 | 10/1952 | France | 123/590 |
| 273509 | 4/1930 | Italy | 123/590 |
| 8544 | of 1907 | United Kingdom | 239/553.3 |
| 384206 | 12/1932 | United Kingdom | 123/593 |
| 724905 | 2/1955 | United Kingdom | 48/189.4 |
| 2061746 | 5/1981 | United Kingdom . | |

*Primary Examiner*—Carl D. Price

*Attorney, Agent, or Firm*—Marshall, O'Toole, Gerstein, Murray & Borun

[57] ABSTRACT

A fuel oil burner has an inlet tube connected to a source of fuel oil and openings in that tube for introducing air or steam into the stream of fuel oil. Located downstream of the openings in the inlet tube is an atomizing element consisting of a plurality of stacks of corrugated plates. The plates in each stack are positioned so that adjacent plates have corrugation directions which are skewed. The configuration of the corrugated plates in each stack provides a plurality of intersecting pathways creating turbulent flow through the atomizing element to atomize or break the fuel oil into small droplets.

4 Claims, 2 Drawing Sheets

FUEL OIL BURNER

BACKGROUND OF THE INVENTION

1. Field of the Invention

The invention relates generally to devices for injecting fuel oil into a boiler or furnace and, more particularly, to devices which mix fuel oil with air or steam to decrease fuel oil droplet size.

2. Background Art

Conventional burners for fuel oil, used in industrial boilers and the like, may be provided with pipes in which fuel oil and steam and/or compressed air are mixed. The pipes terminate in a nozzle having conduits through which the fuel oil is directed radially outwardly, then inwardly through channels, and finally out through openings spaced circularly around a nozzle head. The nozzle effects mixing of the fuel oil with the steam or air and atomizes or reduces the size of the fuel oil droplets.

Decreasing the size of fuel oil droplets is desirable because it creates a more stable flame and the amount of nitrogen oxides ($NO_x$) (particularly NO and $NO_2$, both of which are air pollutants) produced when fuel oil is burned increases with increases in fuel oil droplet size. In addition, it is believed that a small droplet size provides for more efficient burning and thus greater heat production than is created during combustion of fuel oil of larger droplet size. While nozzles of conventional fuel oil burners may decrease droplet size, there is still a need for devices that further lower droplet size.

In the past, modification of fuel oil burners has been constrained by the fact that such modifications generally increase the pressure drop across the atomizing element. Increased pressure drop is undesirable because it requires increasing the fuel oil supply pressure in order to achieve the desired atomization and delivery of sufficient amounts of fuel oil.

Therefore, there is a need for a fuel oil atomizer which decreases droplet size while not unacceptably increasing the pressure drop of the fuel oil as it passes through the atomizer.

SUMMARY OF THE INVENTION

In accordance with one aspect of the invention, a fuel oil atomizer has an inlet tube adapted to communicate at a first end with a source of fuel oil and communicating at a second end with an atomizing nozzle. The atomizing nozzle has an outlet and an atomizing element where the atomizing element comprises a plurality of corrugated plates. The plates have faces contacting faces of the other plates to form a stack having a plurality of intersecting pathways through the stack.

In accordance with another aspect of the invention, each of the corrugated plates has a corrugation direction and the corrugation directions of adjacent plates may be skewed with respect to each other. Preferably, the corrugation direction of each plate may be skewed at an angle of about 45° with respect to the corrugation directions of adjacent plates.

Preferably, each stack comprises at least five plates where each plate has a width and each stack has a central plane. The plates near the central plane of the stack have a greater width than those farther from the central plane so that each stack has a generally circular cross-section.

In accordance with another aspect of the invention, the atomizing element has a plurality of axially disposed stacks of corrugated plates where the plates in each stack are oriented perpendicularly to the plates of adjacent stacks. The atomizing element preferably has at least four stacks.

In accordance with another aspect of the invention, the fuel oil burner has an outer tube surrounding the inlet tube and openings in the inlet tube for allowing air or steam contained in the outer tube to pass into the inlet tube and mix with the fuel oil.

In accordance with another aspect of the invention, a fuel oil burner has an inlet tube adapted to communicate at a first end with a source of fuel oil and connected at a second end to an atomizing nozzle. An outer tube surrounds and is spaced from the inlet tube and openings in the inlet tube allow air or steam contained in the outer tube to pass into the inlet tube and mix with the fuel oil. The atomizing nozzle has an outlet and atomizing element where the atomizing element has a plurality of corrugated plates. The plates have faces and the faces of the plates contact faces of other plates to form a stack of plates having a plurality of pathways through the stack. Each of the corrugated plates has a corrugation direction and the corrugation directions of adjacent plates are at an angle of about 45°. There are at least five plates in each atomizing element, each plate has a width and each atomizing element has a central plane. The atomizing element has a plurality of stacks of corrugated plates where the plates in each stack are oriented perpendicular to the plates in adjacent stacks.

In accordance with another aspect of the invention, a fuel oil burner has an inlet tube adapted to be connected at a first end to a source of fuel oil and connected at a second end to an atomizing nozzle. The atomizing nozzle has means for providing a plurality of pathways where the pathways intersect repeatedly to cause turbulent flow of the fuel oil within those pathways. An outer tube may surround and be spaced from the inlet tube and openings in the inlet tube allow air or steam contained in the outer tube to pass into the inlet tube and mix with the fuel oil. The atomizing nozzle may be upstream of at least one of the openings in the inlet tube.

The pathways may be defined by a plurality of corrugated plates and the corrugated plates may contact each other to form stacks. Each of the plates has a corrugation direction and corrugation directions of each plate are skewed with respect to the corrugation directions of adjacent plates.

BRIEF DESCRIPTION OF THE DRAWINGS

Other features and advantages of the invention will be apparent from the following description taken in connection with the drawings wherein.

DETAILED DESCRIPTION

Figure 1:
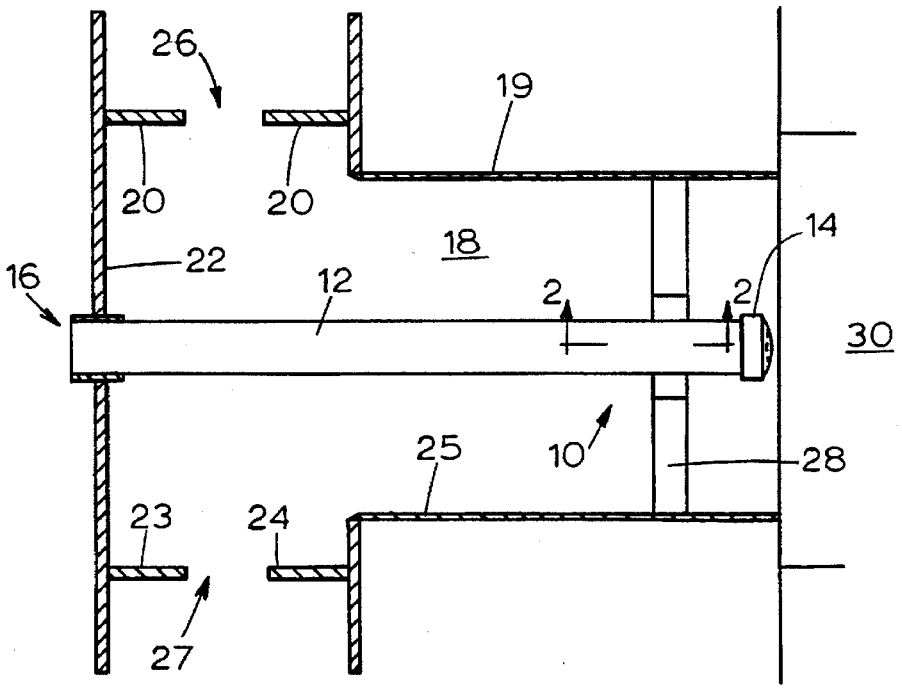
FIG. 1 is a partially sectional side elevational view of furnace including a fuel oil burner of the invention.

Referring to FIG. 1, a fuel oil burner, generally designated 10, has an outer tube 12 terminating at one of its ends in a nozzle cap 14. At its other, upstream end 16, the fuel oil burner 10 is connected to a source of fuel oil (not depicted) and a source of steam or compressed air (not depicted), which, as described below, are mixed prior to combustion. The fuel oil burner 10 is disposed in an intake air chamber 18 defined by walls 19, 20, 21, 22, 23, 24 and 25 into which combustion air passes through openings indicated generally at 26 and 27. The burner 10 is secured to intake air chamber walls 19 and 25 by a bracket 28. The nozzle 14 injects that fuel oil mixture into a combustion chamber 30, where the fuel oil is burned. The burner, as heretofore described, can be obtained commercially from a number of companies including Cleaver Brooks, Division of Aquachem, Inc., P.O. Box 421, Milwaukee, Wis. 53201 and is available in Cleaver Brooks' CB line of packaged boilers.

Figure 2:
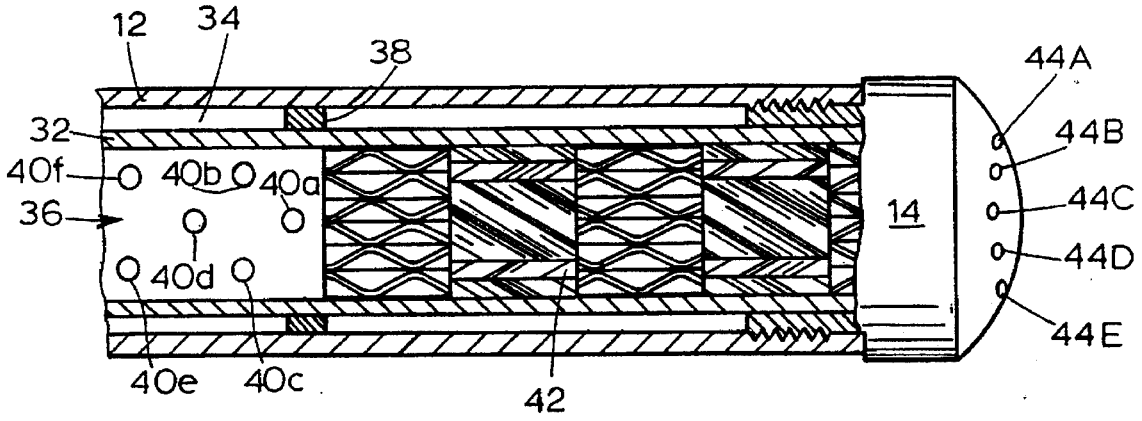
FIG. 2 is a sectional view of the fuel oil burner of FIG. 1 taken along line 2—2.

Referring to FIG. 2, an inlet tube 32 is disposed inside and concentric with the outer tube 12 of the fuel oil burner 10. An annular chamber 34 is formed between the inlet tube 32 and the outer tube 12. The inlet tube 32 has a lumen 36 through which fuel oil is pumped under pressure. Similarly, steam and/or compressed air is forced through the annular chamber 34 which terminates at an annular seal 38. The steam and/or compressed air flows through inlet openings 40A–40F found in the inlet tube 32 so that the fuel oil and the steam and/or air are mixed. The openings 40A–40F are located at approximately 90° angles around the inlet tube 32. Preferably, there are thirty-two openings 40, each ⅛-inch in diameter and drilled at a 45° angle to the axis of inlet tube 32 toward the direction of flow through the tube.

The fuel oil mixture then passes through an atomizing element 42 where it is broken into fine droplets and then out through openings 44A–44E of the nozzle head 14. The nozzle head may have additional openings located symmetrically around the central axis of the nozzle head 14 and drilled at an angle to spray the fuel oil/steam or air mixture broadly into the combustion chamber 30 without spraying so broadly as to direct the mixture onto the walls of that combustion chamber. Optimization of the spray nozzle 14 will be dependent on the particular size or configuration of the boiler or furnace in which it is used.

Figure 3:
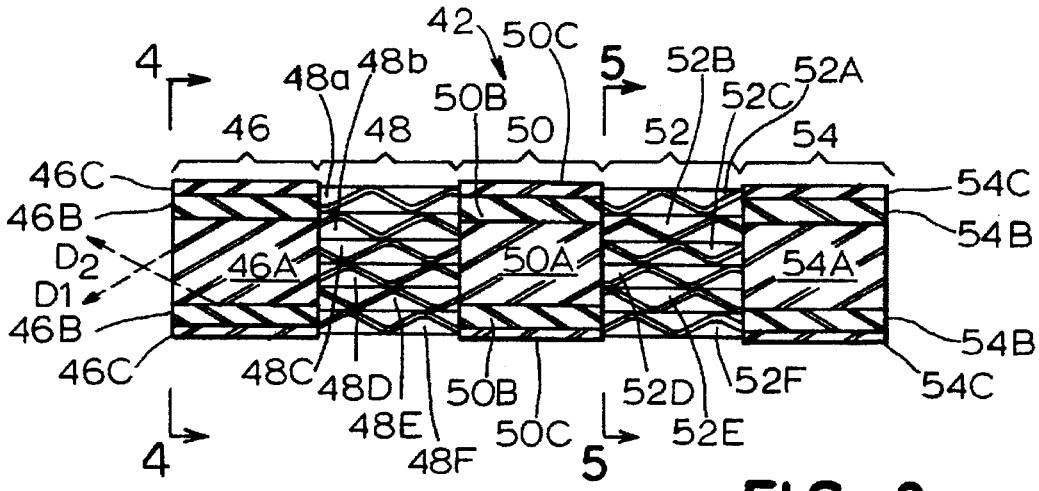
FIG. 3 is a plan view of a fuel oil atomizing element of the burner of FIG. 2.
Figure 4:
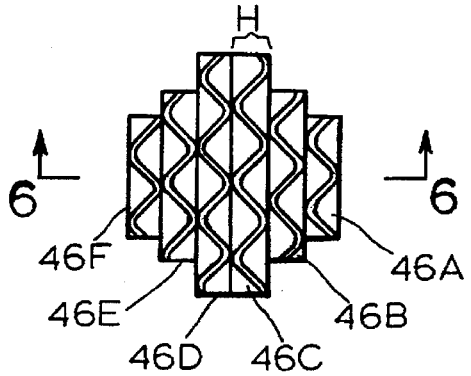
FIG. 4 is an elevational view taken along the line 4—4 of FIG. 3.

Referring now to FIGS. 3–6, the atomizing element 42 comprises five stacks 46, 48, 50, 52, and 54, each comprising six corrugated plates 46A–F, 48A–F, 50A–F, 52A–F, and 54A–F, respectively. Each corrugated plate is formed by bending a flat plate so that it has a series of crests and troughs with a crimp height H (the distance from the top of a crest to the bottom of a trough) as shown in FIG. 4. The crests and troughs in a given corrugated plate are parallel to each other so that each plate has its own corrugation direction, for instance $D_1$ and $D_2$ shown in FIG. 3 for plates 46A and 46B, respectively. The corrugation directions of adjacent plates, i.e., 46A and 46B, are not parallel, but are skewed with respect to each other and preferably are skewed at an angle of 45° as is shown for corrugation directions $D_1$ and $D_2$.

Figure 5:
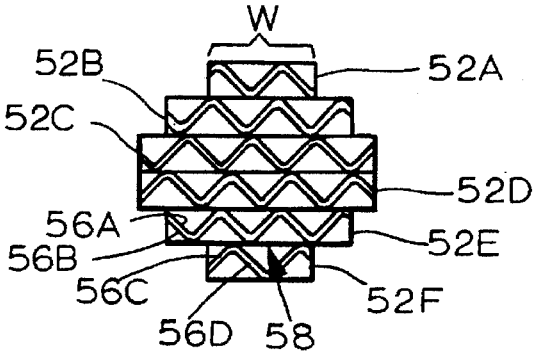
FIG. 5 is a sectional view taken along the line 5—5 of FIG. 3.

Each corrugated plate has an upper face and a lower face. For instance, as shown in FIG. 5, the plate 52E has an upper face 56A and a lower face 56B and the plate 52F has an upper face 56C and a lower face 56D. Because the corrugation directions of adjacent plates are askew, adjacent plates only contact each other where the bottom of a trough of an upper plate meets the top of a crest of lower plate. With respect to plates 52E and 52F, their only contact will be where a trough on face 56B contacts a crest on face 56C. At the contact points between crests and troughs, adjacent plates may be fixed to each other with adhesives or, more preferably, welded together when the corrugated plates are made out of metal or a metal alloy such as stainless steel. The adjacent plates form a myriad of pathways through each stack; for instance, a pathway 58 is defined between corrugated plate 52E and corrugated plate 52F. The pathways are oriented along the corrugation direction of particular plates and repeatedly intersect with pathways formed along the corrugation directions of adjacent plates. The repeated intersection of the skewed pathways creates numerous opportunities for convergence of fuel oil and steam and/or air flowing through the atomizing element 42 which, at sufficient pressures, creates turbulent flow which is believed to aid in the atomization of the fuel oil.

Figure 6:
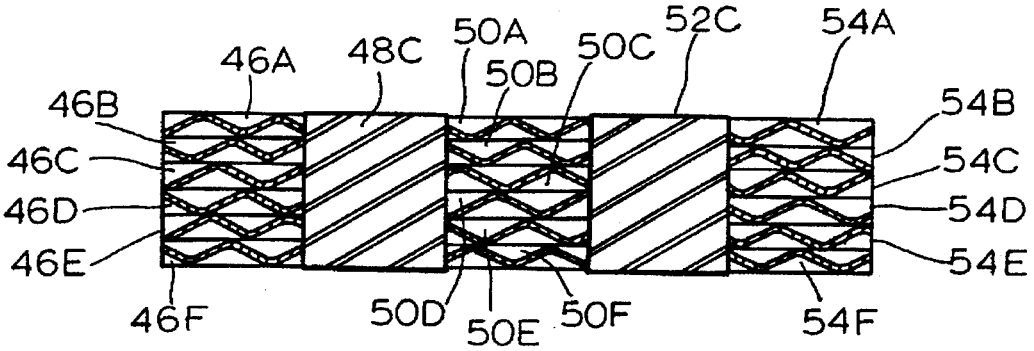
FIG. 6 is a sectional view taken along the line 6—6 of FIG. 4.

As best seen in FIGS. 3 and 6, adjacent stacks are oriented in such a fashion that the corrugated plates in each stack are perpendicular to the corrugated plates in adjacent stacks. As shown in FIG. 3, the faces of the corrugated plates in stacks 46, 50 and 54 are oriented such that they are generally parallel to the page, whereas the faces of the plates in stacks 48 and 52 are oriented to be generally perpendicular to the page. By orienting the plates in adjacent stacks perpendicularly with respect to each other, the pathways of fluid flow through the atomizing element 42 are further induced to converge and produce turbulent flow. The stacks may be fixed to each other with adhesive or welded together to ensure that plates in adjacent stacks maintain their mutually perpendicular orientation.

As seen in FIGS. 4 and 5, the width W of each stack (see FIG. 5) is greatest at the central plane of the stack (e.g., between plates 52C and 52D in FIG. 5) and decreases with increased radial distance from the central plane of the stack. Each stack thereby has a generally circular cross-section so that it will fit into the circular cross-section pipes conventionally used in fuel oil burners. The dimensions of each stack will, therefore, be dependent on the size of the inlet tube into which an atomizing element is placed and should desirably be configured so that the atomizing element fits snugly into the inlet tube to minimize the passage of fuel oil, steam and/or air along the outside of the atomizing element.

Fuel oil atomizing elements of the type depicted in FIGS. 3–6 are commercially available through Koch Engineering Company, Inc., 4111 E. 37th Street North, Wichita, Kans. and are available in a variety of sizes and configurations. Atomizing elements can be purchased in diameters of ¼, ⅜, ½, ¾, 1, 1.5, 2, 3, 4, 6, 8 and 12 inches (0.64, 0.95, 1.27, 1.91, 2.54, 3.81, 5.08, 7.62, 10.16, 15.24, 20.32 and 30.48 cm, respectively), with crimp heights of 1/16, ⅛, ¼, ½, 1 and 2 inches (0.16, 0.32, 0.64, 1.27, 2.54, and 5.08 cm, respectively). Atomizing elements are available with anywhere from 5 to 10 layers or corrugated plates in each stack and with corrugation directions of adjacent plates intersecting at 30° or 45° angles. In addition, it is possible to construct atomizing elements of any other dimension, number of corrugation elements per stack, crimp heights, number of stacks per element and angles between corrugation directions of adjacent plates. The optimal design of any particular atomizing element will be dependent on the desired flow characteristics, pressures, amount of fuel oil, etc., for which a particular burner is designed.

As shown in FIG. 2, it is believed to be most desirable to place the atomizing element 42 as close to the nozzle outlets 44A–44E as is possible. In this way the fuel oil which has been atomized in the atomizing element 42 has little opportunity to reform into larger droplets prior to exiting the nozzle cap 14. Large droplets not only increase $NO_x$ emissions but also create a broad or nonuniform range of fuel oil droplet sizes, leading to flame instability. It is also possible, however, to place the atomizing element into an existing fuel oil burner upstream of an atomizing nozzle already in place.

In such a configuration, the atomizing element 42 would be placed between the openings 40E and an existing nozzle.

When adapting an existing fuel burner for use with the atomizing element 42, it may be desirable to insert pipes, plates, and/or seals in the burner to secure the atomizing element to the burner including the nozzle head. The precise configuration of such pipes, plates and seals, when necessary, will be dependent on the size and configuration of the existing burner and the size of the atomizing element chosen.

EXAMPLE 1

A standard oil gun assembly for a Cleaver Brooks CB400-500 HP boiler having a nozzle tip 48B347 and swirler blank 109A33 was attached to a source of Standard Number 2 Fuel Oil at a pressure of 100 PSIG, which then went through a valve to reduce the pressure to 58 PSIG. Air at 20 PSIG was mixed with the fuel oil upstream of the nozzle and then injected into a boiler and ignited. When running the boiler at full capacity, or high fire, 80 parts per million of $NO_x$ were detected in the effluent from the boiler.

The standard nozzle used above was then modified by removing the swirler nozzle and inserting a ¾-inch diameter by 4½-inch long tube between the nozzle tip and the area where fuel oil and steam were mixed. A four stack Koch Engineering SMV-CY mixing element was placed into the 4½-inch long tube. The elements were ground to a 0.820-inch diameter to fit the inside diameter of the ¾-inch pipe. The SMV-CY element had an original diameter of about ¾ inch, a ⅛-inch crimp height and six layers or corrugations plates per stack. The nozzle tip was unchanged so that the spray pattern into the combustion chamber was essentially identical to that in the standard oil gun assembly. Standard Number 2 Fuel oil at 98 PSIG, reduced in pressure to 58 PSIG, was mixed with air at 32 PSIG and forced through the burner and ignited. $NO_x$ in the effluent from the boiler was measured to be 50 parts per million, a decrease of approximately 37 percent in $NO_x$ pollutants over the standard Cleaver Brooks burner.

EXAMPLE 2

A standard burner as described above in Example 1 was attached to a source of Number 2 Low Nitrogen Fuel Oil at an oil supply pressure of 100 PSIG, reduced to 60 PSIG, which was mixed with air at a pressure of 30 PSIG. $NO_x$ emissions at high fire were measured at 41 parts per million, of 34 parts per million at mid fire and at low fire of 30 parts per million.

The modified fuel oil burner containing the corrugated atomizing element as described above in Example 1 was attached to a source of Number 2 Low Nitrogen Fuel Oil at an oil supply pressure of 100 PSIG, reduced to 60 PSIG, which was mixed with air at a pressure of 31 PSIG. $NO_x$ emissions at high fire were detected to be 27 parts per million, 22 parts per million at mid fire and 16 parts per million at low fire representing a decrease in $NO_x$ emissions of 34 percent at low fire, 35 percent at mid fire and 47 percent at low fire.

The foregoing examples show that by modifying an existing fuel oil burner to add the corrugated fuel oil atomizing element, $NO_x$ emissions were significantly reduced. Reduction in pollutants was achieved without greatly increasing the pressure drop across the atomization element so as to require increased fuel oil supply pressure. It is believed that other designs eliminating entirely the existing nozzle and optimizing the configuration of the atomizer would lead to equal or greater reductions in $NO_x$ emissions. In addition to measuring $NO_x$ emissions, it was visually observed in both Example 1 and Example 2 that the burner flame for the modified nozzle was brighter indicating a hotter and therefore more efficient burning of the fuel oil.

The foregoing detailed description has been given for clearness of understanding only and no unnecessary limitations should be understood therefrom, as modifications will be apparent to those skilled in the art.

I claim:

1. A fuel oil burner comprising:

an inlet tube having a first end adapted to communicate with a source of fuel oil and a second end adapted to communicate with a nozzle having an outlet;

an outer tuber surrounding and spaced from the inlet tube;

openings in the inlet tube for allowing air or steam contained in the outer tube to pass into the inlet tube and mix with fuel oil supplied to the inlet tube from the source; and an atomizing element located in said inlet tube extending from the openings in the inlet tube to the nozzle;

wherein the atomizing element comprises a plurality of corrugated plates having faces contacting faces of similar adjacent plates for creating a plurality of intersecting pathways through the stack; and wherein the atomizing element further comprises a plurality of axially disposed stacks of corrugated plates and the plates in each stack are oriented perpendicularly to the plates in adjacent stacks.

2. The fuel oil burner of claim 1 wherein:

each of the corrugated plates has a corrugation direction; and the corrugation direction of each plate is skewed with respect to the corrugation directions of adjacent plates.

3. The fuel oil burner of claim 2 wherein the corrugation direction of each plate is disposed at an angle of about 45° with respect to the corrugation direction of adjacent plates.

4. The fuel oil burner of claim 2 wherein:

there are at least five plates in each stack;

each plate has a width and each stack has a central plane; and the respective widths of the plates decrease in a radial direction outwardly from the central plane of each stack such that each stack has a generally circular cross-section.

* * * * *